US009144718B2

(12) United States Patent
Johnson et al.

(10) Patent No.: US 9,144,718 B2
(45) **Date of Patent: *Sep. 29, 2015**

(54) GOLF CLUB WITH IMPROVED PERFORMANCE

(71) Applicant: Acushnet Company, Fairhaven, MA (US)

(72) Inventors: Gregory D. Johnson, Carlsbad, CA (US); Ryan Margoles, Carlsbad, CA (US); Charles E. Golden, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/045,534

(22) Filed: Oct. 3, 2013

(65) Prior Publication Data

US 2014/0031139 A1 Jan. 30, 2014

Related U.S. Application Data

(63) Continuation-in-part of application No. 13/973,415, filed on Aug. 22, 2013, now Pat. No. 8,858,357, which is a continuation of application No. 12/911,079, filed on Oct. 25, 2010, now Pat. No. 8,535,173.

(51) Int. Cl.

| | |
|---|---|
| ***A63B 53/06*** | (2015.01) |
| ***A63B 53/02*** | (2015.01) |
| ***A63B 49/06*** | (2006.01) |
| *A63B 53/04* | (2015.01) |

(52) U.S. Cl.

CPC ..... *A63B 53/02* (2013.01); *A63B 49/06* (2013.01); *A63B 53/0466* (2013.01); *A63B 2053/023* (2013.01); *A63B 2053/025* (2013.01); *A63B 2053/026* (2013.01); *A63B 2053/027* (2013.01); *A63B 2053/042* (2013.01); *A63B 2053/045* (2013.01); *A63B 2053/0408* (2013.01); *A63B 2053/0433* (2013.01); *A63B 2053/0491* (2013.01)

(58) Field of Classification Search

CPC .... A63B 53/02; A63B 49/06; A63B 53/0466; A63B 2053/0408; A63B 2053/023; A63B 2053/025; A63B 2053/042; A63B 2053/027; A63B 2053/0433; A63B 2053/0491; A63B 2053/045; A63B 2053/026

See application file for complete search history.

(56) References Cited

U.S. PATENT DOCUMENTS

| | | | | |
|---|---|---|---|---|
| 2,027,452 | A | 1/1936 | Rusing | |
| 5,058,895 | A | 10/1991 | Igarashi | |
| 5,205,553 | A | 4/1993 | Okumoto et al. | |
| 6,001,027 | A | 12/1999 | Hansberger | |
| 6,638,178 | B2 | 10/2003 | Tseng | |
| 6,648,773 | B1 * | 11/2003 | Evans | 473/342 |
| 6,890,269 | B2 | 5/2005 | Burrows | |
| 7,147,570 | B2 | 12/2006 | Toulon et al. | |
| 7,147,572 | B2 | 12/2006 | Kohno | |
| 7,186,190 | B1 | 3/2007 | Beach et al. | |

(Continued)

*Primary Examiner* — Stephen Blau

(74) *Attorney, Agent, or Firm* — Randy K. Chang

(57) ABSTRACT

A golf club head with an improved Moment of Inertia (MOI) is disclosed herein. More specifically, the present invention relates to a golf club head with a releasable hosel mechanism that is leaner and more lightweight, it allows a significant amount of weight to be saved from the hosel portion of the golf club head and used to improve Center of Gravity (CG) location of the golf club head; which contributes to the improvement of the MOI of the golf club head.

7 Claims, 7 Drawing Sheets

(56) References Cited

U.S. PATENT DOCUMENTS

| | | | | |
|---|---|---|---|---|
| 7,438,645 | B2 | 10/2008 | Hsu | |
| 7,476,160 | B2 | 1/2009 | Hocknell et al. | |
| 7,722,475 | B2 | 5/2010 | Thomas et al. | |
| 8,025,587 | B2 | 9/2011 | Beach et al. | |
| 8,622,847 | B2 * | 1/2014 | Beach et al. | 473/307 |
| 2008/0261715 | A1 * | 10/2008 | Carter | 473/291 |
| 2009/0286611 | A1 | 11/2009 | Beach et al. | |

* cited by examiner

GOLF CLUB WITH IMPROVED PERFORMANCE

CROSS-REFERENCE TO RELATED APPLICATIONS

This application is a Continuation-In-Part (CIP) of U.S. patent application Ser. No. 13/973,415, filed on Aug. 22, 2013, which is a Continuation of U.S. patent application Ser. No. 12/911,079, now U.S. Pat. No. 8,535,173, filed on Oct. 25, 2010, the disclosure of which is incorporated by references in its entirety.

FIELD OF THE INVENTION

The present invention relates generally to a golf club with an improved Moment of Inertia (MOI). More specifically, the present invention relates to a golf club head incorporating a leaner and more lightweight releasable shaft system that is capable of generating a substantially higher MOI than other golf club heads that also incorporate a releasable shaft mechanism. Because the improvement in the MOI of a golf club head is at least partially driven by the Center of Gravity (CG) location of the golf club head, the golf club head in accordance with the present invention may generally have a CG location that is lower and further back than other prior art golf club head having such a releasable shaft mechanism.

BACKGROUND OF THE INVENTION

The sport of golf has always been a game that can be enjoyed by a wide array of players having different skill levels. In fact, the game of golf goes so far as to encourage players of different skill levels to complete with one another by creating a unique "handicap" scoring system that factor in the individual golfer's skill level resulting in a level playing field for all of its participants. Hence, in order to appeal to the needs of this diverse group of golfers, golf club designers have developed different golf clubs with multiple components all contributing differently to accommodate for the diverse needs of all the various different golfers.

Because golfers of different skill levels can often have diverging needs from their golf club in terms of performance, finding the right golf club to fit a particular golfer's needs can often be a difficult task due to the numerous variables that goes into the design of a golf club. Variables such as the loft, face angle, lie angle, shaft weight, shaft flex, club length, club weight, and/or swing weight of a golf club are just some of the variables that could be changed in order to correctly customize and fit a golf club to meet the performance needs of a specific golfer.

Traditionally, in order for a golfer to figure out the exact configuration of his or her golf club to meet the his or her needs, a massive amount of pre-constructed golf clubs, each having a different configurations, needs to be provided to the golfer at one location to allow the golfer to properly evaluate his specific needs. This need for a an excessive amount of golf clubs built to different specifications may generally be due to the fact that traditional golf clubs are built together using adhesives between the various components that can not be easily removed from one another.

U.S. Pat. No. 2,027,452 to Rusing provides one of the earlier attempts to address this non-adjustable and non-interchangeable nature of traditional golf clubs by providing a golf club that can be adjusted to modify both its lie and loft. This adjustment of the golf club is achievable by utilizing an annular seat with two rings that are wedge shaped with surfaces that are inclined relative to one another.

U.S. Pat. No. 6,890,269 to Burrows provides a more recent development into this technology by disclosing a temporary shaft-component connection for assembling a selected golf club shaft with a club head and/or hand grip segment, to facilitate custom club design and fitting to suit the needs and preferences of an individual golfer.

U.S. Pat. No. 7,476,160 to Hocknell et al. shows another modern golf club with an interchangeable shaft, wherein the golf club includes a tube mounted in the club head, and a sleeve mounted on a tip end of the shaft. The tube includes a tapered portion and a rotation prevention portion while the sleeve has a frustoconical portion and a keyed portion that are respectively received in the tapered portion and the rotation prevention portion of the tube.

U.S. Patent Publication No. 2009/0286619 to Beach et al. shows another different modern golf club with a connection assembly that allows the shaft to be easily disconnected form the club head. The connection assembly includes a removable hosel sleeve that allows a shaft to be supported at a desired predetermined orientation relative to the club head. In this manner, the shaft loft and/or lie angle of the club can be adjusted without resorting to traditional bending of the shaft.

U.S. Pat. No. 7,722,475 to Thomas et al. shows another different modern golf club head that releasably engages with a shaft so that the club head and the shaft can be readily interchanged and/or so that the shaft position with respect to the club head can be readily changed. The assemblies for connecting the club head and the shaft may include a shaft engaging member that includes a rotation-inhibiting structure, a club head engaging member that includes a shaft-receiving chamber and a retaining structure for engaging the rotation-inhibiting structure, and a securing system for releasably securing the shaft engaging member with respect to the club head engaging member.

U.S. Pat. No. 7,438,645 to Hsu provides another example of a recent solution by providing an adjustable and interchangeable golf club by with a head, a retaining ring, a tightening ring, an adjusting sleeve, a hosel, a fixing sleeve, a coupler, and a shaft, wherein the pin is threadedly engaged with a transverse screw hole of the neck and a transverse screw hole of the hosel and extend into a transverse hole of the coupler, such that that the shaft is pivotable about the pin to allow adjustment in the tilt angle between the shaft and the head.

As it can be seen from above, although these attempts to improve the customizability, adjustability, and interchangeability of a golf club is capable of providing an easier way for a golfer to try different golf clubs with different performance variables without the needs for multiple golf clubs, these complicated solutions used to achieve such adjustability all require an elaborate components near the hosel portion of the golf club head.

For starters, because these complicated adjustable contraptions all revolve around the hosel of the golf club head, the mere size of these additional components create a golf club head with a bulky and aesthetically unappealing hosel that detracts the golfer from being interested in such a product. However, the lack of aesthetic appeal is only the beginning of the undesirability of such a golf club head, as the multiple elements required to incorporate such an adjustable hosel contraption adds a significant amount of weight around the hosel portion of the golf club head. Having excessive weight around the hosel portion of a golf club head may generally be undesirable, as this excessive weight shifts the Center of Gravity (CG) of the golf club head higher and more forward.

It is generally understood in the industry that having a golf club head with a CG location that is higher and more forward is undesirable, as it shifts the CG away from the impact axis between a golf club and a golf ball. In fact, it is generally desirable to have the CG located in an opposite direction than what is described above, yielding a CG location that is lower and further back within the body of the golf club head. This lower and further back CG location may generally be in closer alignment with the impact axis, creating a more efficient energy transfer between the golf club and the golf ball. In addition to creating a more efficient energy transfer, a CG location that is lower and further back from the striking face of the golf club head may increase the Moment of Inertia (MOI) of the golf club head, as more weight being placed away from the impact plane of the golf club head could help the golf club head resist twisting when impacting a golf ball.

Hence it can be seen, there is tremendous need in the field for a golf club that incorporates the technological advancements associated with golf clubs that can incorporate all of the components necessary to offer a golf club that is releasable, adjustable, and/or interchangeable without unduly adding to the size and weight of the hosel. More specifically, there is a need in the field for a golf club head having an adjustable and interchangeable hosel, wherein the weight associated with the components are minimized, yielding a CG location that is lower and further back to improve the performance of the golf club head.

BRIEF SUMMARY OF THE INVENTION

In one aspect of the present invention is a golf club head comprising of a striking face portion, defining a striking face plane, positioned at a forward portion of the golf club head; a body portion, connected to an aft portion of the striking face, positioned at a rearward portion of the golf club head; and a hosel, defining a hosel bore axis, positioned at a heel portion of the golf club head, adapted to connect to a shaft; wherein a first plane intersects a second plane to define a hosel sub-element. The first plane is parallel to the hosel bore axis and the striking face plane, and is offset 15 mm towards the rear portion of the golf club head from the hosel bore axis in a $Z_{HBA}$ direction. The second plane is parallel to the hosel bore axis and perpendicular to the striking face plane, and is offset 12 mm towards a toe portion of the golf club head from the hosel bore axis in a $X_{HBA}$ direction. The hosel releasably connects the shaft to the golf club head, and the hose sub-element has a total mass of less than about 50 grams.

In another aspect of the present invention is a golf club head comprising of a striking face portion, defining a striking face plane, positioned at a forward portion of the golf club head; a body portion, connected to an aft portion of the striking face, positioned at a rearward portion of the golf club head; and a hosel, defining a hosel bore axis, positioned at a heel portion of the golf club head, adapted to connect to a shaft; wherein the hosel releasably connects the shaft to the golf club head, and wherein A CG depth distance along a Z-axis, $CG_Z$, measured from a face center of the striking face portion, and a CG height distance along a Y-axis, $CG_y$, measured from a ground, together satisfy $CG_Y \leq 0.0935 * CG_Z + 26$.

In a further aspect of the present invention is a golf club head comprising of a striking face portion, defining a striking face plane, positioned at a forward portion of the golf club head; a body portion, connected to an aft portion of the striking face, positioned at a rearward portion of the golf club head; and a hosel, defining a hosel bore axis, positioned at a heel portion of the golf club head, adapted to connect to a shaft; wherein the hosel releasably connects the shaft to the golf club head, and wherein A CG depth distance along a Z-axis, $CG_Z$, measured from a face center of the striking face portion, and a CG height distance along a Y-axis, $CG_y$, measured from a ground, together satisfy $$CG_Z \geq \frac{CG_Y + 48.5}{2.16}.$$

In an even further aspect of the present invention is a golf club head comprising of a striking face portion, defining a striking face plane, positioned at a forward portion of the golf club head; a body portion, connected to an aft portion of the striking face, positioned at a rearward portion of the golf club head; and a hosel, defining a hosel bore axis, positioned at a heel portion of the golf club head, adapted to connect to a shaft; wherein a CG height distance along a Y-axis, $CG_Y$, measured from a ground is less than about 30 mm.

In an even further aspect of the present invention is a golf club head comprising of a striking face portion, defining a striking face plane, positioned at a forward portion of the golf club head; a body portion, connected to an aft portion of the striking face, positioned at a rearward portion of the golf club head; and a hosel, defining a hosel bore axis, positioned at a heel portion of the golf club head, adapted to connect to a shaft; wherein the golf club head has a Moment of Inertia (MOI) about a Y-axis of greater than about 460 kg*mm$^2$.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
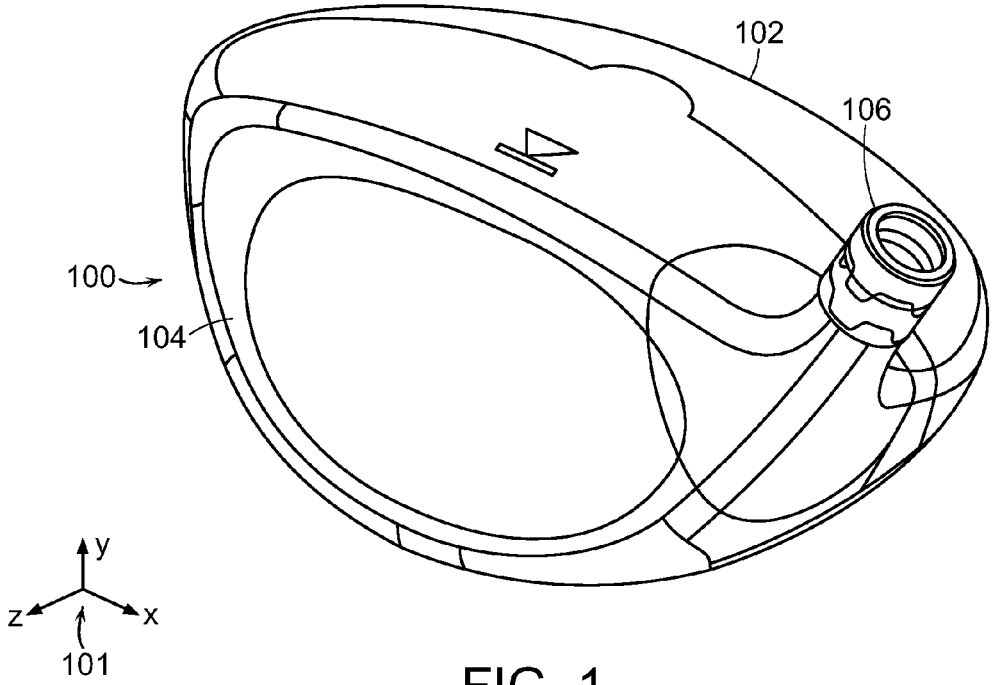
FIG. 1 shows a perspective view of a golf club head containing an releasable hosel mechanism in accordance with an exemplary embodiment of the present invention.

FIG. 1 of the accompanying drawings shows a perspective view of a golf club head 100 in accordance with an exemplary embodiment of the present invention. More specifically, FIG. 1 shows a golf club head 100 with a releasable hosel mechanism 106. The golf club head 100, as shown in the current exemplary embodiment, may generally be comprised of a body portion 102 and a striking face portion 104; wherein the striking face portion 104 may generally be used to strike a golf ball. Striking face portion 104, as described in this current application, may generally refer to the portion of the golf club head 100 that is substantially vertical at the frontal portion of the golf club head, demarcated by the radius of curvature that blends into the crown, sole, and skirt. The releasable hosel mechanism 106 shown in the current exemplary embodiment may generally be adapted to connect to a shaft (not shown) in such a way that the golf club head 100 and the shaft (not shown) may be releasable from one another. In addition to providing an overall view of the inventive golf club head 100, FIG. 1 also shows a reference coordinate system 101 defining the relative x, y, and z axes used in the current application. According to the reference coordinate system 101, the X-axis runs horizontally across the striking face portion 104 of the golf club head 100 in a heel to toe direction, the Y-axis runs vertically across the striking face portion 104 of the golf club head 100 in a crown to sole direction, and the Z-axis runs in a forward and backward direction in and out of the striking face portion 104 of the golf club head 100.

Figure 2:
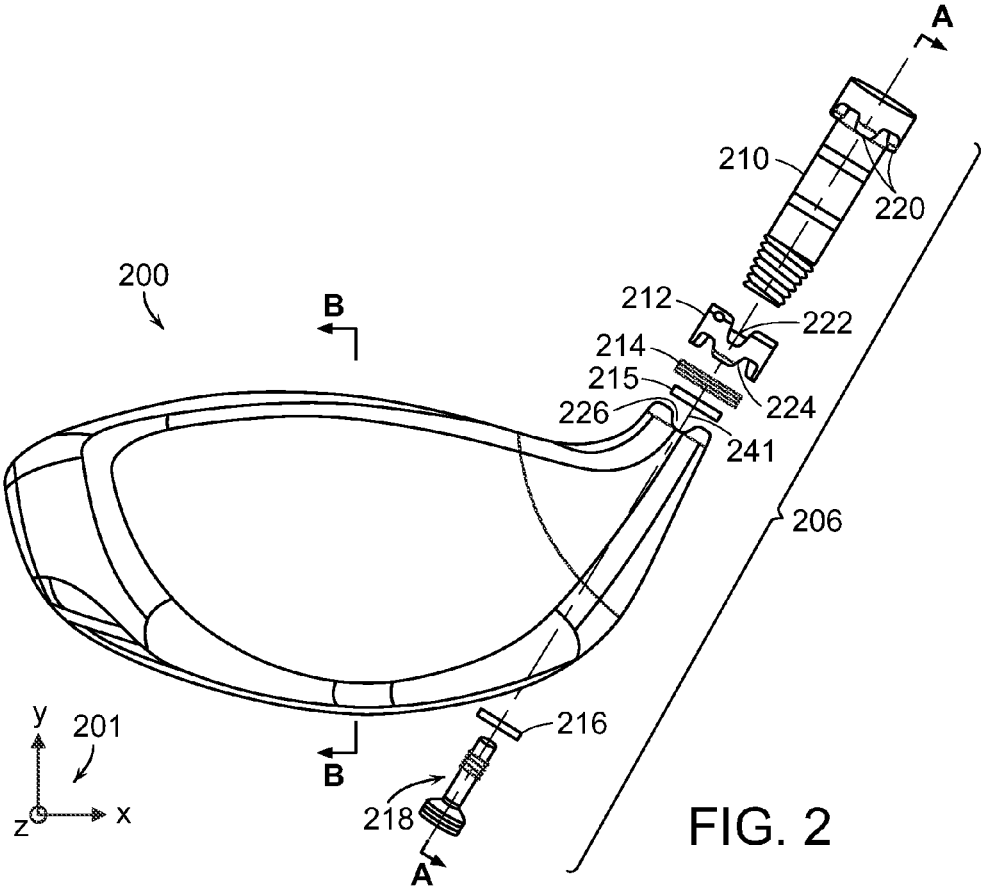
FIG. 2 shows a frontal exploded view of a golf club head in accordance with an exemplary embodiment of the present invention allowing the internal components of a releasable hosel mechanism to be shown.

In order to provide a clearer view of the internal components of the releasable hosel mechanism 106, FIG. 2 is created showing an exploded view of the various internal components generally of the releasable hosel mechanism 206. More specifically, the releasable hosel mechanism 206 in this exemplary embodiment of the present invention may generally comprise of multiple components, including, but not limited to, a shaft sleeve 210, a wedge ring 212, a wedge ring retainer 214, a fastener retainer 215, a concave washer 216, and a fastener 218. First and foremost, it is worth noting that the present invention, although disclosing the components that are necessary for this particular embodiment, is not limited to the components discussed above. In fact, the releasable hosel mechanism 206 in accordance with the present invention may have more components than what is shown in FIG. 2, less components than what is shown in FIG. 2, or even completely different components than what is shown in FIG. 2, all without departing from the scope and content of the present invention, so long as it incorporates a releasable hosel mechanism 206.

In this exemplary embodiment of the present invention, the shaft sleeve 210 may further comprise of a plurality of tangs 220, which are adapted to engage a plurality of notches 222 on the wedge ring 212. The wedge ring 212 itself, may further be comprised of a plurality of tangs 224 that are adapted to engage a plurality of notches 226 within the hosel of the golf club head 200 itself. In order to ensure that the wedge ring 212 doesn't separate from the shaft sleeve 210, a wedge ring retainer 214 is threadedly attached to the bottom portion of the shaft sleeve 210 after the wedge ring 212 is assembled. The wedge ring retainer 214 helps ensure that the wedge ring 212 doesn't separate from the shaft sleeve 210 by creating a thicker outer diameter near the bottom of the shaft sleeve 210. The shaft sleeve 210, together with the wedge ring 212 is adapted to connect to the golf club head 200 via a fastener 218, which engages the shaft sleeve 210 via the bottom of the golf club head 200. The fastener 218 may generally be comprised of external threads, which engages the internal threads at the bottom end of the shaft sleeve 210. In order to ensure that the fastener 218 functions properly, two more additional components are added to the releasable hosel mechanism 206. First, a fastener retainer 215 is used to secure the fastener 218 within the hosel portion of the golf club head 200, preventing the fastener 218 from falling out of its place within the golf club head 200. In addition to the fastener retainer 215, a concave washer 216 is positioned near the head of the fastener 218, to allow the fastener 218 to properly engage the shaft sleeve 210 regardless of the angle of attachment.

Figure 3:
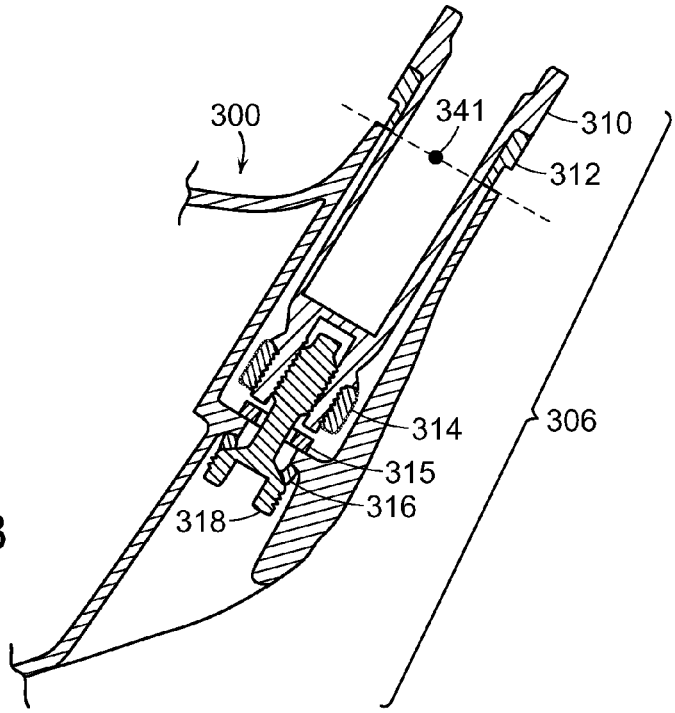
FIG. 3 shows a cross-sectional view of a releasable hosel mechanism of a golf club head in accordance with an exemplary embodiment of the present invention.

FIG. 3 showing a cross-sectional view of this releasable hosel mechanism 206 provides a clearer understanding of the relationships between the various components. The cross-sectional view of the releasable hosel mechanism 206 shown in FIG. 3 may generally be a cross-sectional view taken down the middle of the releasable hosel mechanism shown by cross-sectional line A-A' in FIG. 2. The assembled view of the releasable hosel mechanism 306 contains the same components are previously mentioned in FIG. 2; including but not limited to the shaft sleeve 310, the wedge ring 312, the wedge ring retainer 314, the fastener retainer 315, the concave washer 316, and the fastener 318. The cross-sectional view shown in FIG. 3 also shows the internal surfaces of the shaft sleeve 310 to be tilted relative to the actual hosel of the golf club head 300, allowing the loft, lie, and face angle of the golf club head 300 to be altered depending on the. In addition to the tilted internal surface of the shaft sleeve 310, the wedge ring 312 may also have the tangs tilted relative to one another to create a further angular change between the golf club shaft and the club head 300 without departing from the scope and content of the present invention. More details regarding the detail operation of this releasable hosel mechanism 306 may be found in U.S. patent application Ser. No. 12/560,930, the disclosure of which is incorporated by reference in its entirety.

Despite all the performance advantages associated with having a releasable hosel mechanism 306, it can be seen from above that such a releasable hosel mechanism 306 requires numerous components that could add additional mass to the hosel portion of the golf club head 300. As it is commonly known in the industry, additional mass at the hosel portion of a golf club head 300 may generally be undesirable, as it places weight at a portion of the golf club head 300 that may adversely affect the performance of the golf club head 300. Hence, there is significant advantage to designing a simple releasable hosel mechanism 306 as shown above that minimizes the mass associated with such a mechanism.

In the current exemplary embodiment of the present invention, the releasable hosel mechanism 306, comprising of a shaft sleeve shaft sleeve 310, the wedge ring 312, the wedge ring retainer 314, the fastener retainer 315, the concave washer 316, and the fastener 318, may have a mass that is significantly lighter than most traditional releasable hosel mechanisms in order to improve the performance of the golf club head 300. More specifically, the releasable hosel mechanism 306 in accordance with this exemplary embodiment of the present invention may have a mass of less than 10 grams, more preferably less than about 9.5 grams, and most preferably less than about 9.0 grams. Because the relative mass dedicated to the releasable hosel mechanism 306 is so important to the performance of the golf club head 300, it is worthwhile to determine a suitable definition for the various components that can be included to define the releasable hosel mechanism 306. Releasable hosel mechanism 306, as defined in the current application, may generally refer to the additional components that will be needed to releasably connect the shaft (not shown) to the golf club head 300, irrespective of how the connection is achieved.

For example, in the current exemplary embodiment shown in FIG. 3, the releasable hosel mechanism 306 may include all the components such as the shaft sleeve 310, the wedge ring 312, the wedge ring retainer 314, the fastener retainer 315, the concave washer 316, and the fastener 318; none of which will be needed in a conventional glued golf club head 300. It is worth repeating that the components discussed here that constitute the releasable mechanism 306 should not be construed in a limiting sense, or even in an expansive sense, as any and all components necessary to convert a conventional glued hosel to an releasable hosel mechanism 306 should be included. Finally, it should be noted that although the various components included in the releasable mechanism 306 of this exemplary embodiment may all be removable from the body of the golf club head 300, these various components could be fixedly incorporated into the golf club head 300, the shaft or the hosel and still be considered part of the releasable hosel mechanism 306 without departing from the scope and content of the present invention.

The current invention achieves a leaner and lighter releasable hosel mechanism 306 by utilizing a vast number of different technologies. First and foremost, the current invention seeks to create a leaner and lighter releasable hosel mechanism 306 by eliminating unnecessary components that adds excessive mass to the system. In the current exemplary embodiment of the present invention, the shaft sleeve 310, the wedge ring 312, the wedge ring retainer 314, the fastener retainer 315, the concave washer 316, and the fastener 318 are all important to the creation of the robust releasable and adjustable mechanism 306 in this embodiment of the present invention, thus all unnecessary components have been eliminated to save weight. Secondly, the current invention creates a leaner and lighter releasable hosel mechanism 306 by utilizing lightweight materials to form the various components of the releasable hosel mechanism 306. For example, the shaft sleeve 310 in the current embodiment may be constructed out of aluminum having a density of about 2.7 g/cm$^3$ to reduce the mass of the shaft sleeve 310, however, numerous other material such as plastic having a density of about 0.9 g/cm$^3$, nylon type material having a density of about 1.15 g/cm$^3$, and carbon fiber type material having a density of about 1.75 g/cm$^3$ may all be used without departing from the scope and content of the present invention.

In addition to the above, the current invention further decreases the mass within the releasable hosel mechanism 306 by decreasing the physical size and dimensions of the various components within the releasable hosel mechanism 306. For example, the fastener 318 in the current exemplary embodiment may have a reduced length of less than about 17.00 mm, more preferably less than about 16.5 mm, and most preferably less than about 16.35 mm to create a more compact fastener 318 to reduce unnecessary mass. In another example, the wall thickness of the shaft sleeve 310 may be reduced to be less than about 1.00 mm at its thinnest portion, more preferably less than about 0.90 mm at its thinnest portion, and most preferably less than about 0.80 mm at its thinnest portion, to create a more compact shaft sleeve 310 to further reduce unnecessary mass.

Figure 4:
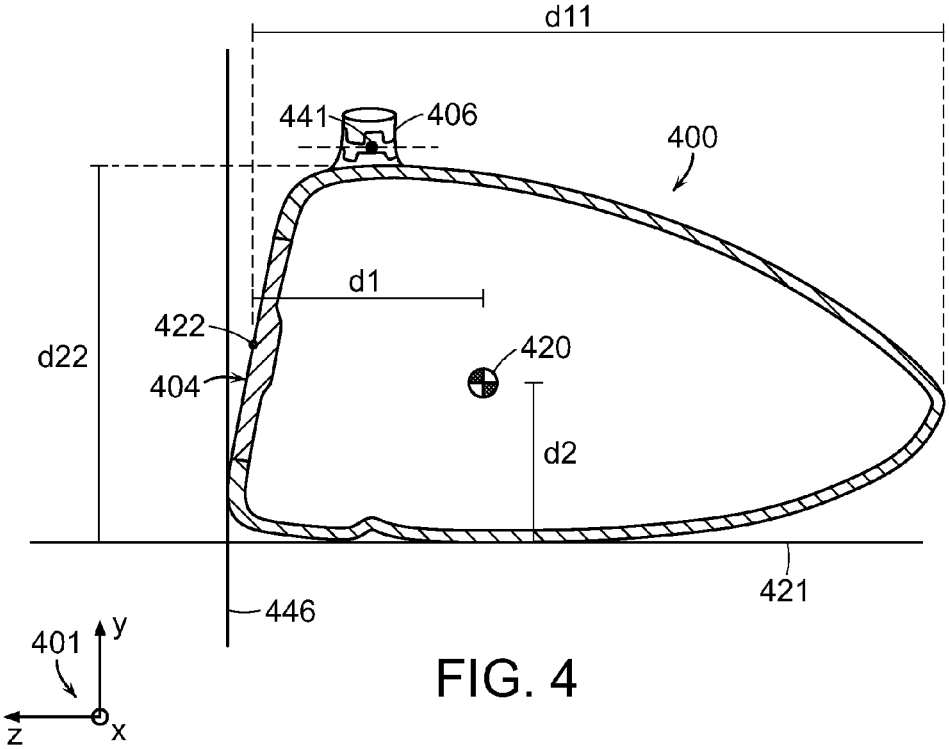
FIG. 4 of the accompanying drawing shows a cross-sectional view of a golf club head in accordance with an exemplary embodiment of the present invention illustrating its Center of Gravity (CG) location.

The present invention, with its leaner and lightweight releasable hosel mechanism 306, allows additional mass to be shifted away from the hosel portion of the golf club head. This amount of discretionary weight, as it is commonly known in the industry, may generally be strategically placed at locations that help move the Center of Gravity (CG) of the golf club head lower and further back to improve the performance of the golf club head 300; as a lower and further back CG location, amongst other things, promotes greater Moment of Inertia (MOI) of the golf club head. FIG. 4 of the accompanying drawings showing a cross-sectional view of a golf club head 400 in accordance with an exemplary embodiment of the present invention that incorporates a leaner and lightweight releasable hosel mechanism 406. This cross-sectional view of the golf club head 400 may generally be taken across cross-sectional line B-B' shown in FIG. 2 for ease of representation, but the CG 420 location may not necessarily be along this cross-sectional plane; as FIG. 4 is only used to illustrate the location of the CG 420 along the Y and Z axes shown by coordinate system 401.

The lower and further back CG 420 location of the current inventive golf club head 400 may be more easily identified by two distances d1 and d2 in the two dimensional space shown in FIG. 4. Distance d1 measures the depth of the CG 420 along the Z-axis from the face center 422, and may generally be greater than about 35 mm, more preferably greater than about 36 mm, and most preferably greater than about 37 mm. In order to properly determine the distance d1, it is important to first properly define the face center 422 of the golf club head 400. Face center 422, as described in this application, may generally refer to the geometric center of the striking face portion 104 (shown in FIG. 1) of the golf club head 400. Distance d2, on the other hand, measures the height of the CG 420 along the Y-axis starting from the ground 421 reference plane, and may generally be less than about 30 mm, more preferably less than about 29 mm, and most preferably less than about 28 mm. The distances d1 and d2 are important to the performance of the golf club head 400, as a deeper and lower CG 420 location may generally help improve the MOI of the entire golf club head 400 as well as improve launch conditions.

Although absolute values for the depth distance d1 and for the height distance d2 may generally be sufficient to quantify the relative CG 420 locations of a golf club head 400, it may not be sufficient to capture the essence of the present invention in unconventional shaped golf club heads. Thus, in order to provide an alternative way to capture the lower and deeper CG 420 location of a golf club head, a relative location of the CG 420 location could be created as a ratio to the overall size of the golf club head 400. Referring back to FIG. 4, we can see that a golf club head in accordance with an exemplary embodiment of the present invention may generally have a total depth d11 of greater than about 105 mm, more preferably greater than about 107.5 mm, and most preferably greater than about 110 mm. Additionally, FIG. 4 also shows the golf club head 400 having a total height d22 of greater than about 60 mm, more preferably greater than about 61.5 mm, and most preferably greater than about 63 mm. Based on the dimensions of the golf club head 400 above, a CG depth ratio can be calculated to be greater than about 0.32, more preferably greater than about 0.335, and most preferably greater than about 0.35; wherein the CG depth ratio is defined by the depth distance d1 divided by the total depth d11. Based on the same calculation, a CG height ratio can also be calculated to be greater than about 0.43, more preferably greater than about 0.465, and most preferably greater than about 0.50; wherein the CG height ratio is defined by the height distance d2 divided by total height d22.

Because a deeper and lower CG 420 location is such a desirable characteristic to improve the performance of the golf club head 400, and because both of these values work in conjunction with one another, specific relationships between the height distance d2 and depth distance d1 may be created to capture their relationship relative to one another; which quantifies the improved performance of the current inventive golf club head 400. More specifically, Equation (1) below shows a relationship of height distance d1 as function of the depth distance d2, focusing on getting the CG 420 lower.

$$CG_Y(d1) \leq 0.0935 * CG_Z(d2) + 26 \quad \text{Eq. (1)}$$

Equation (2), on the other hand, shows a relationship of the depth distance d2 as a function of the height distance d1, focusing on getting the CG 420 deeper.

$$CG_Z(d2) \geq \frac{CG_Y(d1) + 48.5}{2.16} \quad \text{Eq. (2)}$$

Although all this discussion regarding the CG 420 location of the golf club head 400 is useful to help determine the measurable characteristics of a golf club head 400 in accordance with the present invention, one of the ultimate goals is still to create a golf club head 400 with improved performance in terms of increased MOI. Because of the current inventive golf club head 400 utilizes a leaner and more lightweight releasable hosel mechanism 406, the mass saved from the releasable hosel mechanism 406 may be used to improve the CG 420 location, which in turn, improves the MOI of the golf club head 400 if that weight saved is strategically shifted away from the CG of the golf club head 400. A golf club head 400 in accordance with this exemplary embodiment of the present invention, may generally be capable of achieving MOI numbers along the Y-axis of greater than about 460 kg*mm$^2$, more preferably greater than about 475 kg*mm$^2$, and most preferably greater than about 485 kg*mm$^2$ without departing from the scope and content of the present invention. Although the MOI of a golf club head 400 along the Y-axis may generally be the most sought after performance gains, the MOI of a golf club head 400 along the X-axis may also be important to the performance of the golf club head 400. The golf club head 400 in accordance with this exemplary embodiment of the present invention may generally be capable of achieving MOI numbers along the X-axis of greater than about 250 kg*mm$^2$, more preferably greater than 270 kg*mm$^2$, and most preferably greater than about 280 kg*mm$^2$.

Before moving onto further discussion that concentrates on the mass of the releasable hosel mechanism 406, it is worth whole to acknowledge the striking face plane 446 shown in FIG. 4. Striking face plane 446, as defined in the current invention, may generally refer to a reference plane that is substantially vertical in orientation and tangent to the leading edge of the striking face 404 of the golf club head 404. Alternatively speaking, striking face plane 446 may also be defined as a plane that is drawn in an X-Y plane that is tangent to the leading edge of the striking face 404 of the golf club head 400.

Recognizing that the leanness and lightweight properties of the releasable hosel mechanism 406 may include components that are fixedly attached to the golf club head 400, the mere mass of the removable components such as the shaft sleeve shaft sleeve 310, the wedge ring 312, the wedge ring retainer 314, the fastener retainer 315, the concave washer 316, and the fastener 318 (shown in FIG. 3) may not provide a sufficient methodology to quantify the leanness and lightweight properties of the releasable hosel mechanism 406, the present invention has created a new way to capture the mass of the releasable hosel mechanism 406. More specifically, the present invention bifurcates the golf club head 400 into two separate and distinct parts that can be individually measured irrespective of the connectivity of the various components.

Figure 5:
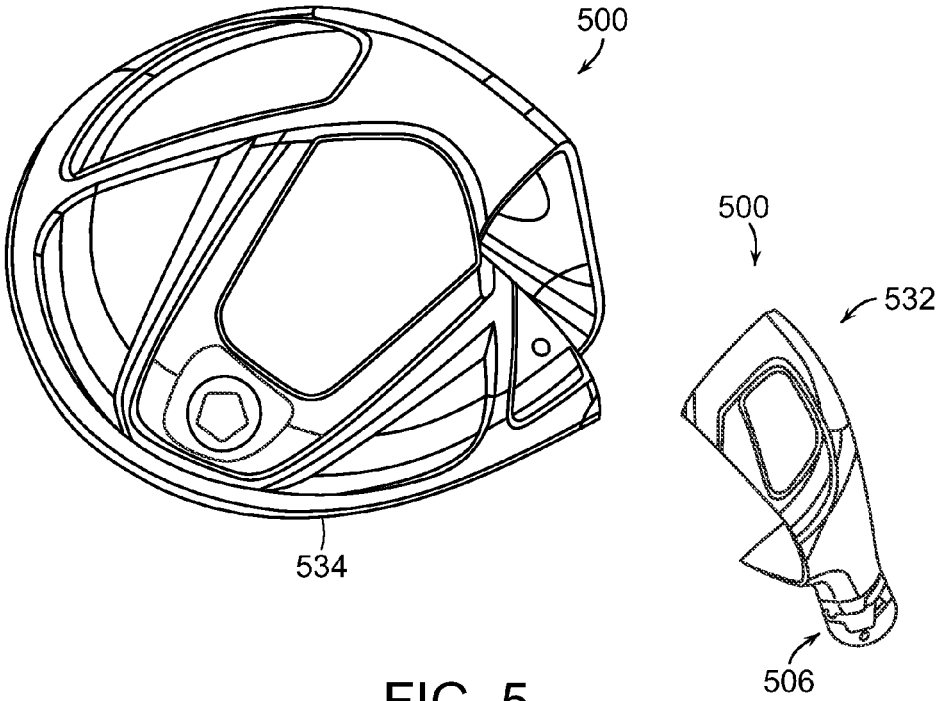
FIG. 5 shows an exploded perspective view of a bifurcated golf club head in accordance with an exemplary embodiment of the present invention.

FIG. 5 of the accompanying drawing shows an exploded perspective view of a golf club head 500 that has been bifurcated into a hosel sub-element 532 and a body sub-element 534. It should be noted that in this bifurcation process, the hosel sub-element 532 may generally include all of the components that are necessary to create the releasable hosel mechanism 506 in an attempt to evaluate more holistically quantify the leanness and lightweight properties of the releasable hosel mechanism 506. Hence, because the releasable hosel mechanism 506 in accordance with the present invention is leaner and more lightweight, the hosel sub-element 532 may weigh less resulting in a mass of less than about 50 grams, more preferably less than about 45 grams, and most preferably less than about 44 grams. This lighter weighed hosel sub-element 532 may generally allow more mass to be placed in the body sub-element 534, yielding a body sub-element that may have a mass of more than about 150 grams, more preferably greater than about 155 grams, and most preferably greater than 156 grams. The relative mass of the hosel sub-element 532 and the body sub-element 534 could be used to generate a hosel sub-element mass ratio, defined by Equation (3) below.

$$\text{Hosel Sub-Element Mass Ratio} = \frac{\text{Mass of Hosel Sub-Element (532)}}{\text{Overall Mass of Golf Club Head (500)}} \quad \text{Eq. (3)}$$

The hosel sub-element mass ratio defined above by Equation (3) quantifies the amount of discretionary weight that could potentially be created as a function of the mass of the entire golf club head 500. The golf club head 500 in accordance with an exemplary embodiment of the present invention may generally have a hosel sub-element mass ratio of less than about 0.25, more preferably less than about 0.225, and most preferably less than about 0.22.

Figure 6:
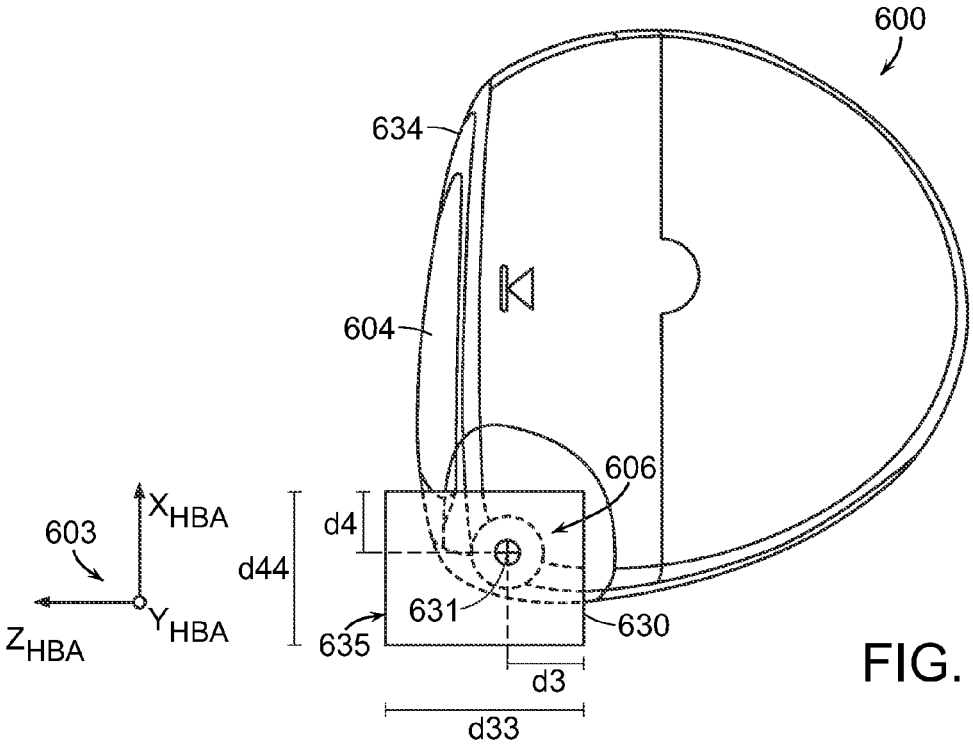
FIG. 6 shows a top view of a golf club head along a hosel bore axis in accordance with an exemplary embodiment of the present invention.

Based on the above, it can be seen that the leaner and lighter weight releasable hosel mechanism 506 will yield a lighter hosel sub-element 534, which in turn creates a lower hosel sub-element mass ratio. However, the mass associated with the hosel sub-element 532 can not be accurately determined unless the boundaries of this bifurcation can be clearly defined. FIG. 6 of the accompanying drawing accomplishes this by providing a top view of the golf club head 600 in accordance with an exemplary embodiment of the present invention allowing the bifurcation line 630 to be clearly identified.

Right off the bat, it is important to recognize that the top view of the golf club head 600 shown in FIG. 6 is not taken from the natural resting position of the golf club head 600. In fact, in order to accurately capture the leanness and lightweight properties of the releasable hosel mechanism 606, the bifurcation lines are drawn in an orientation that keeps the hosel bore axis 631 in a completely vertical position. Orientating the golf club head 600 in this is preferred because it helps focus the dimensions of the bifurcation line 630 around the releasable hosel mechanism 606. In order to properly capture this new orientation used to isolate the releasable hosel mechanism 606, a new coordinate system 603 needs to be created based off the hosel bore axis 631 of the golf club head. This new coordinate system may generally have an $Y_{HBA}$ axis running coincident to the hosel bore axis 631, a $X_{HBA}$ axis perpendicular to the hosel bore axis 631 in a heel to toe direction, and a $Z_{HBA}$ axis perpendicular to the hosel bore axis in a front to rear direction.

In defining the boundaries of the bifurcation line 630, FIG. 6 provides several dimensions within this new coordinate system 603 to provide an easily identifiable bifurcation line 630. Bifurcation line 630, as shown in FIG. 6 may generally create a cutout rectangle 635 having a length d33 of about 50 mm and width d44 of about 40 mm. The placement of this cutout rectangle 635 may generally be constrained by the hosel bore axis 631, as the hosel bore axis 631 is the central point of the releasable hosel mechanism 606. In order to determine the placement of this cutout rectangle 635 within the orientation provided by FIG. 6, two additional dimensional distances d3 and d4 may be provided, with distance d3 being at a precise distance of 15 mm and distance d4 at a precise distance of 12 mm. Distance d3 may generally refer to the location of the cutout rectangle 635 into the golf club head 600 along the $Z_{HBA}$ axis, measured from the hosel bore axis 631. Distance d4, on the other hand, may generally refer to the location of the cutout rectangle 635 into the golf club head 600 along the $X_{HBA}$ axis, measured form the hosel bore axis 631.

Figure 7:
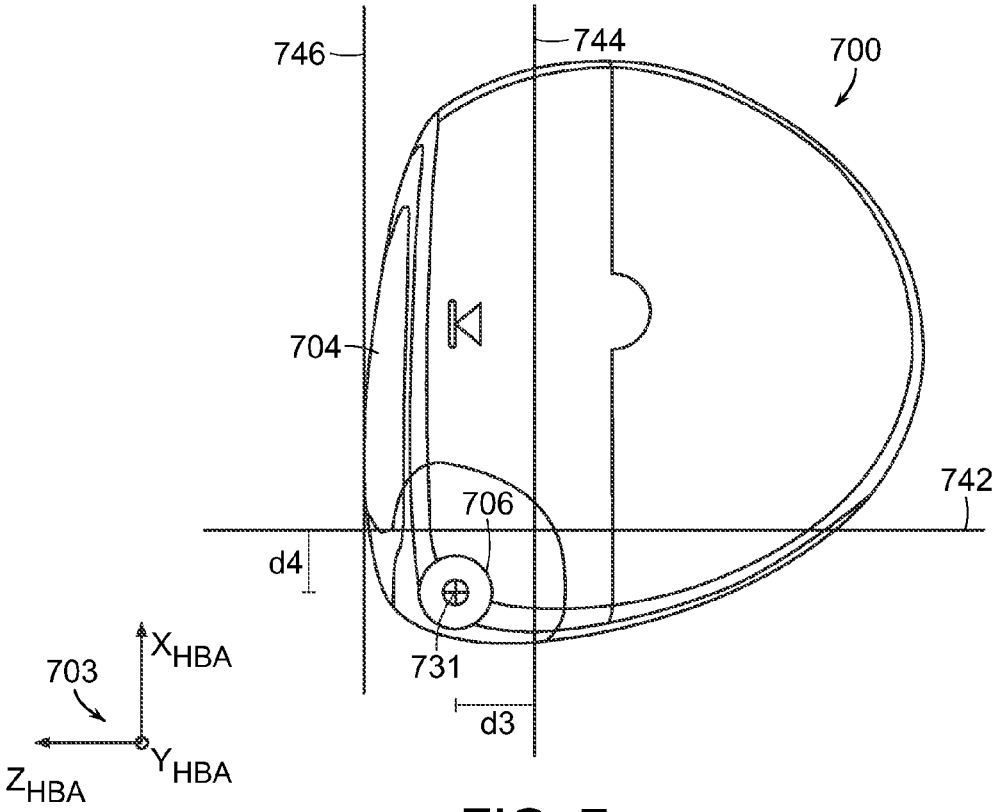
FIG. 7 shows a top view of a golf club head along a hosel bore axis in accordance with an exemplary embodiment of the present invention.

FIG. 7 of the accompanying drawings showing a top view of the golf club head 700 provides an alternative methodology to help define the hosel sub-element 532 (shown in FIG. 5). More specifically, instead of utilizing a cutout rectangle 635 (shown in FIG. 6) to capture the hosel sub-element 532 (shown in FIG. 5), this alternative methodology utilizes two intersecting planes 742 and 744 that are both parallel to the hosel bore axis 731. The first plane 742 is placed at a distance d3 of 15 mm rearward from the hosel bore axis 631 along the $Z_{HBA}$ direction, while being parallel to a striking face plane 746. The second plane is placed at a distance d4 of 12 mm toeward from the hosel bore axis 631 along the $X_{HBA}$ direction perpendicular to the striking face plane 746. The striking face plane 746, previously defined by earlier discussions as striking face plane 446 (shown in FIG. 4), may generally be a vertical plane that is tangent to the leading edge of the striking face 704 of the golf club head 700.

Figure 8:
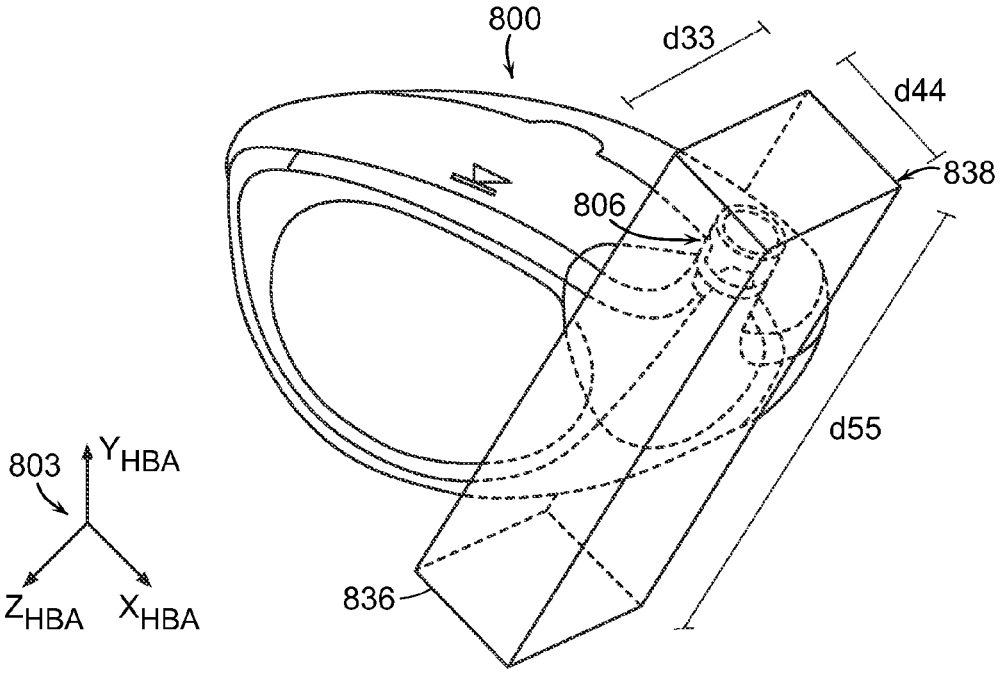
FIG. 8 shows a perspective view of a golf club head in accordance with an exemplary embodiment of the present invention isolating a hosel sub-element from the golf club head.

Knowing what we know about a golf club head 600 being a three-dimensional object, it goes without saying that the cutout rectangle 635 (shown in FIG. 6) would need some depth to completely define the boundaries hosel sub-element 532 (shown in FIG. 5). FIG. 8 of the accompanying drawings provides a perspective view of the golf club head 800 showing a cutout cuboid 836, which expands on the cutout rectangle 635 (shown in FIG. 6) by adding an additional dimension of depth. Cuboid 836, as defined in the present invention, may generally have a rectangular prism shape and has sufficient depth to encompass the entire height of the golf club head 800. As FIG. 8 shows, cuboid 836 may have a length distances d33 of about 50 mm, a width distance d44 of about 40 mm, and a depth distance of d55 of about 200 mm in length. Although the Y-axis placement of the cuboid 836 within the three-dimensional space is not critical, it is critical that the depth of the cuboid 836 encompasses the entirety of the golf club head 800 to allow the hosel sub-element 532 (shown in FIG. 5) to be distinguished from the body sub-element 534 (shown in FIG. 5). Hence, in one exemplary embodiment of the present invention, the depth of the cuboid 836 may have its top surface 836 at a distance of 25 mm above the top surface of the releasable hosel mechanism 806.

This cuboid 836 identified in FIG. 8 provides another way to quantify the mass of the hosel sub-element 532 (see FIG. 5) that signifies the leanness and lightweight properties of the releasable hosel mechanism 806. More specifically, with the dimensions of the cuboid 836 in mind, it can be said that the mass of the golf club head 800 encompassed by the cuboid 836 may generally have a mass of less than about 50 grams, more preferably less than about 45 grams, and most preferably less than about 44 grams. This alternative methodology, although may not yield a different result from the discussion above utilizing planes 742 and 746 (shown in FIG. 7), provides a three dimensional boundary to isolate all of the relevant components of the releasable hosel mechanism 806 from the body of the golf club head 800.

Figure 9:
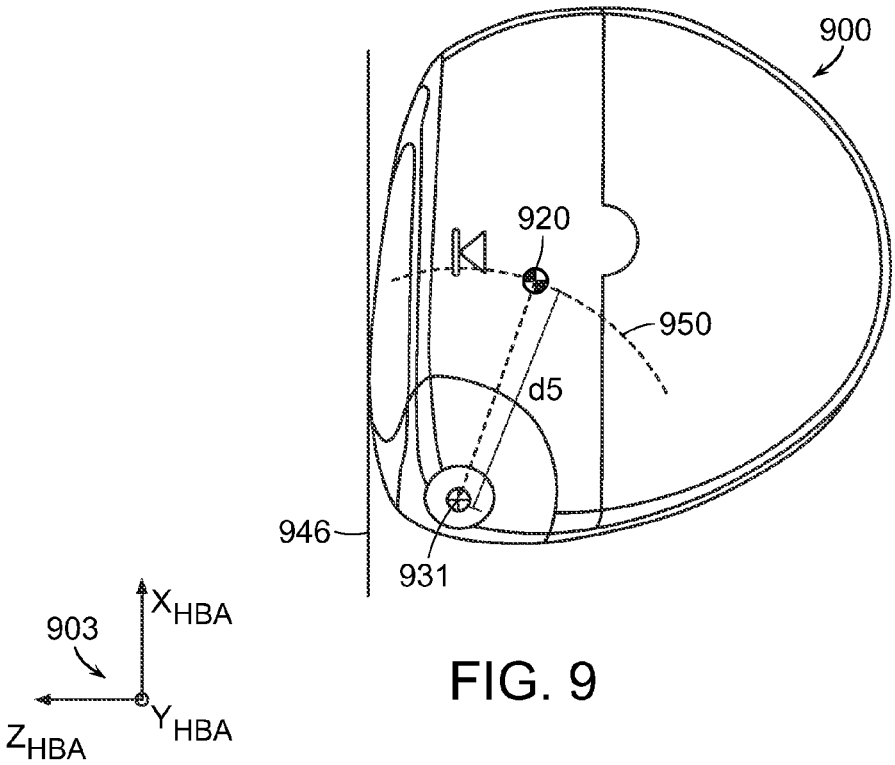
FIG. 9 shows a top view of a golf club head along the hosel bore axis in accordance with an exemplary embodiment of the present invention.

FIG. 9 of the accompanying drawings shows a top view of an inventive golf club head 900 along the hosel bore axis 931, as previously explained in FIG. 6, highlighting the relationship of the CG 920 location within this particular reference frame. More specifically, FIG. 9 of the accompanying drawings shows the CG 920 location at a distance d5 away from the hosel bore axis 931, wherein distance d5 may generally be greater than 34 mm, more preferably greater than 35 mm, and most preferably greater than 36 mm. This alternative way of classifying the CG 920 location relative to the hosel bore axis 931 provides a different way to quantify the depth of the CG 920 location, which is necessary to quantify the shift in CG 920 location as the face angle of the golf club head 900 changes. In order to illustrate this change in CG 920 location as the face angle of the golf club head 900 changes, FIG. 10 is provided.

Figure 10:
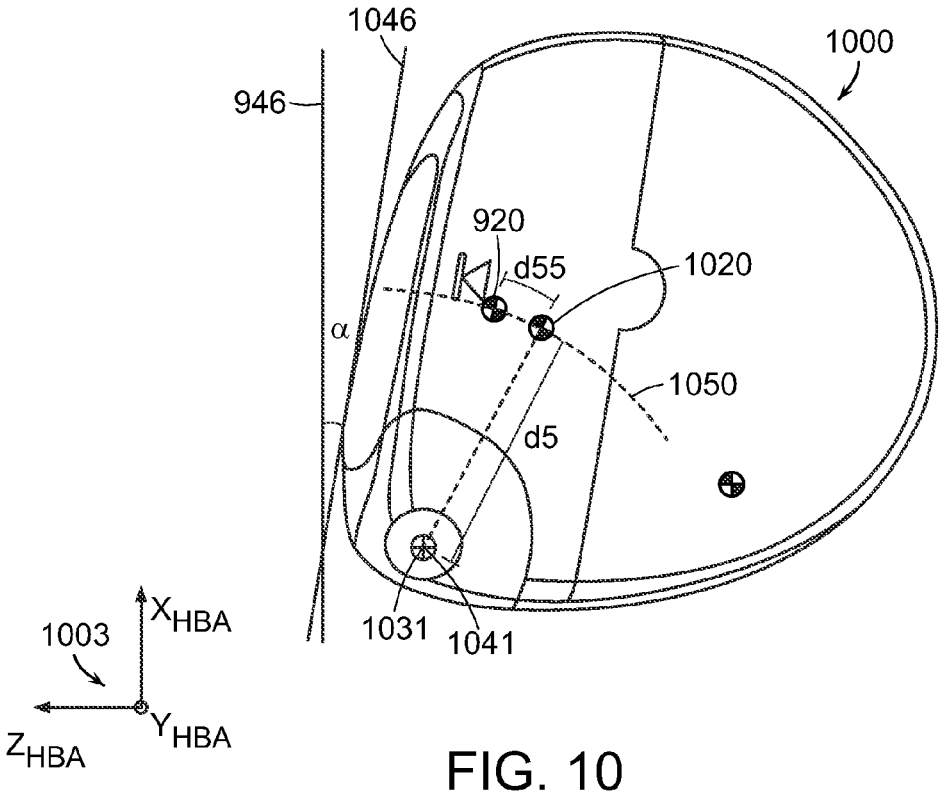
FIG. 10 shows a top view of a golf club head orientated along the hosel bore axis in accordance with an exemplary embodiment of the present invention.

FIG. 10 of the accompanying drawings shows a top view of an inventive golf club head 1000 in accordance with an exemplary embodiment of the present invention wherein the face angle 1046 is rotated to be slightly more open than the neutral face angle 946 position. More specifically, golf club head 1000 may have a face angle 1046 that forms an angle $\alpha$ with a neutral face angle 946, wherein $\alpha$ could be any number of positive values or negative values without departing from the scope and content of the present invention. In the current exemplary embodiment $\alpha$ may generally be 1 degree open, but $\alpha$ could be ½ a degree open, 1½ degree open, ½ degree closed, 1 degree closed, 1½ degree closed all without departing from the scope and content of the present invention. The golf club head 1000 shown in FIG. 10 with a slightly open face angle 1046 also shows the movement of the CG 1020 location from its neutral position 920 as the face angle 1046 of the golf club head shifts from the neutral face angle 946. This shift in CG 1020 location, as shown in the current exemplary embodiment, may generally have an arc distance d55 of greater than about 0.59 mm, more preferably greater than about 0.61 mm, and most preferably greater than about 0.63 mm. Alternatively speaking, a golf club head 1000 in accordance with an exemplary embodiment of the present invention may generally have an arc distance d55 movement of greater than about 0.59 mm for every degree change in the face angle $\alpha$ of the golf club head 1000, more preferably greater than about 0.61 mm, and most preferably greater than about 0.63 mm. This arc distance d55 may generally be defined as the distance along an arc 1050 formed along the circumference of a circle that is perpendicular to the hosel bore axis 1031 having the hosel bore axis 1031 as its center point with a radius defined by the distance d5.

Based on the earlier discussions about the current inventive golf club head 1000 having a lower and deeper CG 1020 location, FIG. 10 illustrates how such a deeper CG 1020 location may result in a greater arc distance d55 movement as the face angle 1046 of the golf club head 1000 changes. This relationship between the arc distance d55 change and the face angle 1046 helps quantify the improvements in the performance of the golf club head 1000, which can sometimes be difficult to quantify.

Based on the movement of the face angle 1046 above, combined with the change in CG 1020 location accompanying the change; it can be seen that changes to the loft and lie of the golf club head 1000 could also contribute to the change of the CG 1020 location of the golf club head 1000. Hence, in order to quantify the change in CG 1020 in the three different axes, $X_{HBA}$, $Y_{HBA}$, and $Z_{HBA}$, a Cartesian coordinate system with an origin 1041 needs to be established. Here, the origin 1041 is used to determine the location of a CG 1020 as the hosel is placed into different settings that offer different loft, lie, and face angle adjustments. In the current exemplary embodiment, the origin 1041 is placed directly along the shaft axis, at a point just on top of the hosel portion of the golf club head 1000 excluding the components of the releasable hosel mechanism. FIGS. 2, 3, and 4 also containing references to the origin 241, 341, and 441 respectively, may also shed more insight on the exact location of the origin 1041 by providing alternative views of the golf club head.

Once the origin 1041 is established, the change of CG 1020 location as the releasable hosel mechanism changes the loft, lie, and face angle of the golf club head 1000 can be defined. Using the coordinate system 1003, Table 1 below provides the different locations of the CG 1020 relative to the origin in accordance with one exemplary embodiment of the present invention.

TABLE 1

| Setting | Loft, Lie, and Face Angle | CG-X | CG-Y | CG-Z |
|---|---|---|---|---|
| A1 | 8.5 loft, 58.50 lie, and 0.5 open face | 40.2 | 57.7 | −19.2 |
| B1 | 8.5 loft, 57.75 lie, and 0.5 open face | 40.3 | 58 | −18.9 |
| C1 | 7.75 loft, 57.75 lie, and 1.5 open face | 39.7 | 57.7 | −19.6 |
| D1 | 7.75 loft, 58.50 lie, and 1.5 open face | 40.2 | 57.7 | −20.2 |
| — | — | — | — | — |
| A2 | 8.5 loft, 60.0 lie, and 0.5 open face | 41.2 | 57.3 | −18.2 |
| B2 | 8.5 loft, 59.25 lie, and 0.5 open face | 40.5 | 57.6 | −18.1 |
| C2 | 7.75 loft, 59.25 lie, and 1.5 open face | 40.6 | 57.5 | −18.6 |
| D2 | 7.75 loft, 60.0 lie, and 1.5 open face | 41.6 | 56.9 | −18.3 |
| — | — | — | — | — |
| A3 | 10.0 loft, 60.0 lie, and 1.5 close face | 41 | 56.2 | −15.2 |
| B3 | 10.0 loft, 59.25 lie, and 0.5 close face | 40.7 | 57.7 | −15.7 |

TABLE 1-continued

| Setting | Loft, Lie, and Face Angle | CG-X | CG-Y | CG-Z |
|---|---|---|---|---|
| C3 | 9.25 loft, 59.25 lie, and 0.5 close face | 41 | 58 | −16.8 |
| D3 | 9.25 loft, 60.0 lie, and 0.5 close face | 41.5 | 56.5 | −15.3 |
| — | — | — | — | — |
| A4 | 10.0 loft, 58.50 lie, and 1.5 close face | 40.2 | 58.1 | −18.3 |
| B4 | 10.0 loft, 57.75 lie, and 1.5 close face | 39.2 | 58.7 | −17.7 |
| C4 | 9.25 loft, 57.75 lie, and 0.5 close face | 39 | 58.4 | −18.4 |
| D4 | 9.25 loft, 58.50 lie, and 0.5 close face | 39.7 | 58.1 | −18.7 |

It should be noted that the above settings refer to the settings associated with the Titleist 910 metalwood driver and all loft, lie, and face angles mentioned above are also based on those settings above.

Seeing the dramatic change in the CG 1020 location as the golf club head is changed into different settings, it can be seen that there is a need for a CG adjustment member that is capable of compensating for the changes occurring above to retain a constant CG 1020 location irrespective of the loft, lie, and face angle changes. Alternatively speaking, there is a need for a CG adjustment member capable of reverting the adverse CG changes associated with a loft, lie, or face angle adjustment, back to its neutral original state.

Figure 11:
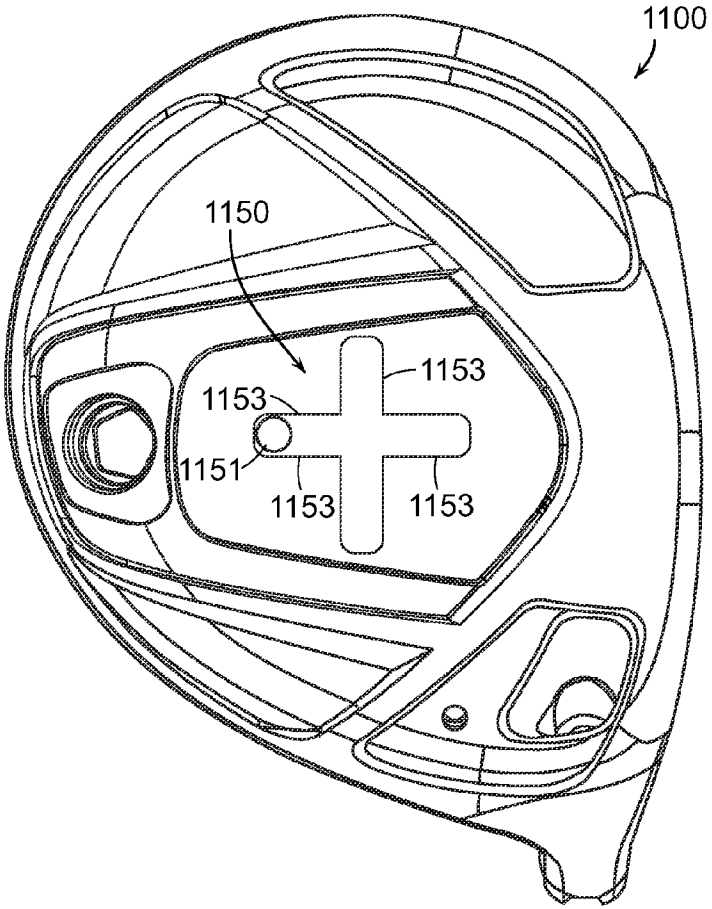
FIG. 11 shows a sole view of a golf club head in accordance with an alternative embodiment of the present invention.

FIG. 11 of the accompanying drawing shows a sole view of a golf club head 1100 in accordance with an alternative embodiment of the present invention further comprising of a CG change compensation weight member 1150. The CG change compensation weight member 1150 is made out of a plurality of sliding channels 1153 allowing the weight 1151 to be placed at any strategic location that is desirable to readjust for the change in CG location change that can result from adjusting the releasable hosel mechanism.

Figure 12:
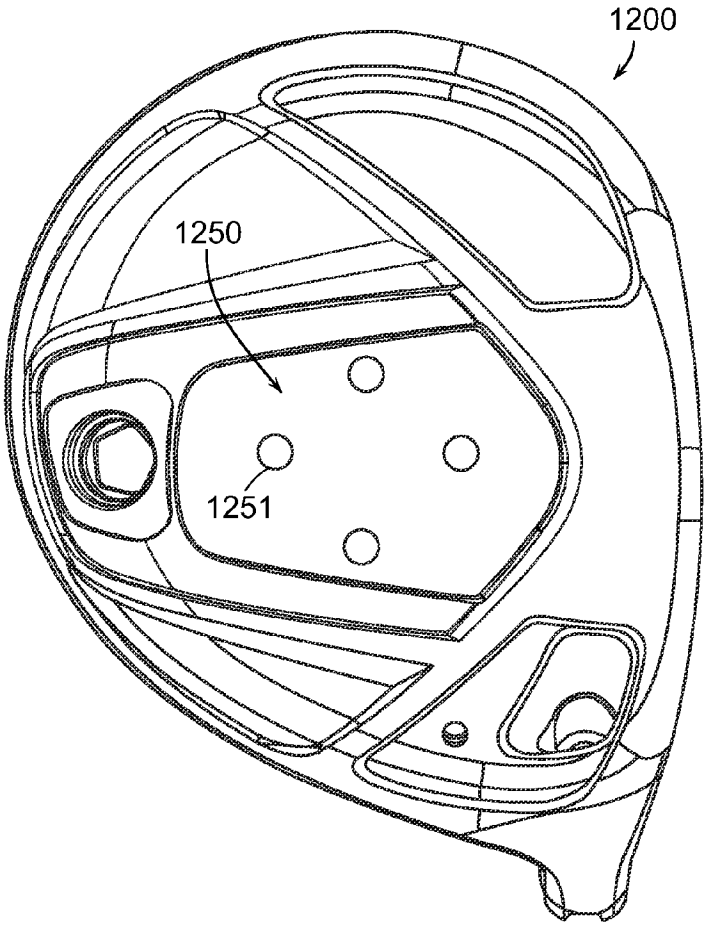
FIG. 12 shows a sole view of a golf club head in accordance with a further alternative embodiment of the present invention.

FIG. 12 of the accompanying drawing shows a sole view of a golf club head 1200 with a CG change compensation weight member 1250 in accordance with an alternative embodiment of the present invention. In this alternative embodiment, the CG change compensation weight member 1250 does not contain any sliding channels, but rather only have weights 1251 that can be made out of different materials to be placed at different locations to offset the CG change from the releasable hosel mechanism, resulting in a more consistent CG location of the golf club head.

Figure 13:
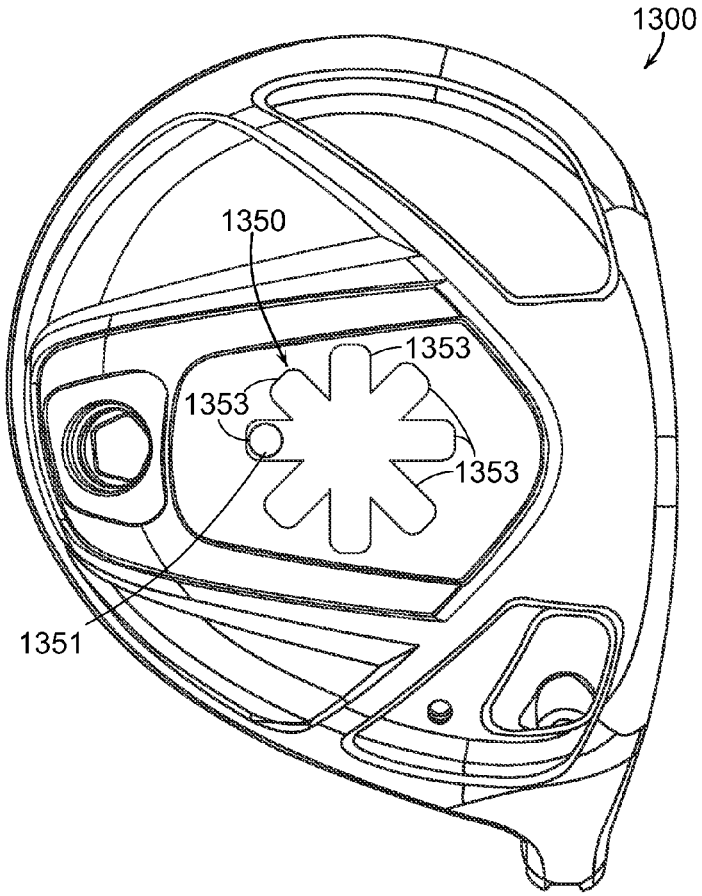
FIG. 13 shows a sole view of a golf club head in accordance with a further alternative embodiment of the present invention.

Finally, FIG. 13 of the accompanying drawings shows a sole view of a golf club head 1300 with a CG change compensation weight member 1350 in accordance with a further alternative embodiment of the present invention. More specifically, in this embodiment, the CG change compensation weight member 1350 may have multiple sliding channels 1353 that could yield 8 different locations, allowing more adjustability by placing the weights 1351 at numerous different locations.

It should be noted that the number of locations for the weight member 1350 in all of these afore mentioned embodiments can change, and may contain more than the illustrated locations without departing from the scope and content of the present invention. In certain embodiments, the location of the weight member 1350 may be recessed into the sole portion of the golf club head to make CG adjustments in the $Y_{HBA}$ axis also without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

We claim:

1. A golf club head comprising:

a striking face portion position at a forward portion of said golf club head;

a body portion, connected to an aft portion of said striking face, positioned at a rearward portion of said golf club head;

a hosel portion, defining a hosel bore axis, positioned at a heel portion of said golf club head, adapted to connect to a shaft;

wherein said hosel portion further comprises a releasable hosel mechanism, capable of altering at least one of a loft, a lie, and a face angle of said golf club head, and wherein said body portion further comprises a CG compensation weight member, said CG compensation weight member reverts any change in a CG location attributed to said releasable hosel mechanism, and wherein said hosel portion forms a hosel sub-element, said hosel sub-element has a total mass of less than about 50 grams;

said hosel sub-element, defined by an intersection of a first plane and a second plane, contains a portion of said clubhead from said first plane to the very heel of said clubhead from top to bottom, and from said second plane to the very front of said clubhead from top to bottom, said first plane is parallel to both said hosel bore axis and a striking face plane, and is offset 15 mm towards said rear portion of said golf club head from said hosel bore axis in a $Z_{HBA}$ direction, said $Z_{HBA}$ is defined as an axis perpendicular to a hosel bore axis in a front to rear direction and said second plane is parallel to said hosel bore axis and perpendicular to said striking face plane, and is offset 12 mm towards a toe portion of said golf club head from said hosel bore axis in a $X_{HBA}$ direction, said $X_{HBA}$ is defined as an axis perpendicular to said hosel bore axis in a heel and toe direction; and the golf club head has a Moment of Inertia (MOI) about a Y-axis of greater than about 460 kgmm^2 with said Y-axis running vertical across said golf club head in a crown to sole direction through the center of gravity of the head.

2. The golf club head of claim 1, wherein said CG compensation weight member further comprises a plurality of sliding channels and a weight.

3. The golf club head of claim 2, wherein said weight is placed within said plurality of sliding channels.

4. The golf club head of claim 1, wherein said total mass of said hosel sub-element has a mass of less than about 45 grams.

5. The golf club head of claim 4, wherein said total mass of said hosel sub-element has a mass of less than about 44 grams.

6. The golf club head of claim 1, wherein said golf club head has a Moment of Inertia (MOI) about the Y-axis of greater than about 475 $kg*mm^2$.

7. The golf club head of claim 6, wherein said golf club head has a Moment of Inertia (MOI) about the Y-axis of greater than about 485 $kg*mm^2$.

* * * * *